US008121298B2

(12) United States Patent
Ochi et al.

(10) Patent No.: US 8,121,298 B2
(45) Date of Patent: Feb. 21, 2012

(54) HEARING AID

(75) Inventors: Akira Ochi, Ehime (JP); Yasushi Ueda, Ehime (JP); Shigekiyo Fujii, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/212,517

(22) Filed: Aug. 18, 2011

(65) Prior Publication Data

US 2011/0299710 A1 Dec. 8, 2011

Related U.S. Application Data

(63) Continuation of application No. PCT/JP01/00799, filed on Feb. 14, 2011.

(30) Foreign Application Priority Data

Mar. 8, 2010 (JP) ..... 2010-050266
Mar. 16, 2010 (JP) ..... 2010-059065

(51) Int. Cl.
*H04R 25/00* (2006.01)

(52) U.S. Cl. ..... 381/23.1; 381/315; 381/323

(58) Field of Classification Search ..... 381/23.1, 381/312, 314, 315, 320, 321, 323, 92; 340/517, 340/521, 540, 636.1, 692
See application file for complete search history.

(56) References Cited

U.S. PATENT DOCUMENTS

| | | | | |
|---|---|---|---|---|
| 6,320,969 | B1 * | 11/2001 | Killion | 381/323 |
| 6,549,633 | B1 * | 4/2003 | Westermann | 381/312 |
| 7,020,296 | B2 * | 3/2006 | Niederdrank | 381/315 |
| 7,843,337 | B2 * | 11/2010 | Maruoka et al. | 340/540 |
| 2007/0230714 | A1 | 10/2007 | Armstrong | |

FOREIGN PATENT DOCUMENTS

| | | |
|---|---|---|
| JP | 2002-10396 | 1/2002 |
| JP | 1 843 633 | 10/2007 |
| JP | 2007-282222 | 10/2007 |
| JP | 2009-253343 | 10/2009 |
| JP | 2010-45772 | 2/2010 |

OTHER PUBLICATIONS

Written Opinion of the International Searching Authority issued May 10, 2011 in International (PCT) Application No. PCT/JP2011/000799.

* cited by examiner

*Primary Examiner* — Huyen D Le
(74) *Attorney, Agent, or Firm* — Wenderoth, Lind & Ponack, L.L.P.

(57) ABSTRACT

The invention is a hearing aid that is mounted on both the left and right ears and generates a notification sound to notify the user to a state change. This hearing aid comprises a first hearing aid and a second hearing aid mounted on the left and right ears, respectively. The first and second hearing aids each have a communication unit, an operating unit, a notification sound generator, and a notification sound generation delay unit. The communication unit performs communication between the first and second hearing aids. The operating unit changes the operating state of the first and second hearing aids. The notification sound generator generates a notification sound when the operating state of the first and second hearing aids changes due to operating of the operating unit. The notification sound generation delay unit controls the notification sound generator of the first hearing aid or the second hearing aid so as to delay by a specific amount the timing at which a notification sound is generated by the notification sound generator in the first hearing aid or the second hearing aid, on the basis of delay time information received through the communication unit.

13 Claims, 6 Drawing Sheets

When there is a shift in the timing at which the notification sounds are generated by the left and right hearing aids 10L and 10R

HEARING AID

This application is a Rule 1.53(b) Continuation of International Application No. PCT/JP2011/000799 with the International Filing Date of Feb. 14, 2011.

TECHNICAL FIELD

The present invention relates to controlling a notification sound in hearing aids mounted on the left and right ears.

BACKGROUND ART

With a conventional hearing aid, a notification sound is issued to the user in various situations, such as when there is a change in the mode suited to the environment in which the hearing aid is used (hereinafter referred to as program), or when there is a decrease in the remaining battery charge.

Many different kinds of information are thus conveyed to the user, and different sounds are generated so that the user can tell them apart. As an example, there is a known technique in which greater variety in the notification sound is afforded by changing the time intervals at which the notification sounds are issued, the number of times they are issued, and so forth.

CITATION LIST

Patent Literature

Japanese Laid-Open Patent Application 2009-253343

SUMMARY

However, with a conventional hearing aid in which the user distinguishes among notification sounds by means of how many times they are issued, although there is no problem when the hearing aid is worn on only one ear, if it is worn on both ears there may be a difference in the distance from the operating unit between the left and right hearing aids, for example, and this may cause a discrepancy timing at which the notification sounds are generated from the left and right hearing aids. In this case, the user ends up hearing the notification sound more times than it was intended to be issued, making it difficult to ascertain the type of notification sound.

In view of this, it is an object of the present invention to provide a binaural hearing aid with which it is easy to catch notification sounds, which is accomplished by controlling the timing at which the notification sounds are generated by the two hearing aids.

The hearing aid pertaining to the present invention is mounted on the left and right ears, respectively, and generates a notification sound that notifies the user of a state change, said hearing aid comprising a first hearing aid and a second hearing aid mounted on the left and right ears, respectively. The first and second hearing aids each have a communication unit, an operating unit, a notification sound generator, and a notification sound generation delay unit. The communication unit performs communication between the first and second hearing aids. The operating unit changes the operating state of the first and second hearing aids. The notification sound generator generates a notification sound when the operating state of the first and second hearing aids is changed due to operating of the operating unit. The notification sound generation delay unit controls the notification sound generator of the second hearing aid or the first hearing aid so as to delay by a specific amount the timing at which a notification sound is generated by the notification sound generator in the first hearing aid or the second hearing aid, on the basis of delay time information received through the communication unit.

The above-mentioned state change of the hearing aid includes a case in which the sound volume of the left and right hearing aids is changed, a case in which the speech processing program for optimally performing hearing aid processing in the left and right hearing aids is switched, and so forth. The above-mentioned notification sound includes beeping sounds (electronic sounds) such as "beep," "beep-beep," and "beep-beep-beep," as well as melodies, human speech, and so forth.

With the binaural hearing aid of the present invention, the timing at which the notification sounds are generated by the hearing aids mounted on both ears is controlled so that, for example, the timing at which the notification sounds generated by the left and right hearing aids will be clearly shifted so as not to overlap, or the timing at which the notification sounds generated by the left and right hearing aids is synchronized rather than being shifted, which makes it easier for the user to catch the notification sounds.

DESCRIPTION OF EMBODIMENTS

The hearing aid pertaining to an embodiment of the present invention will now be described in detail through reference to the drawings.

Embodiment 1

Figure 1:
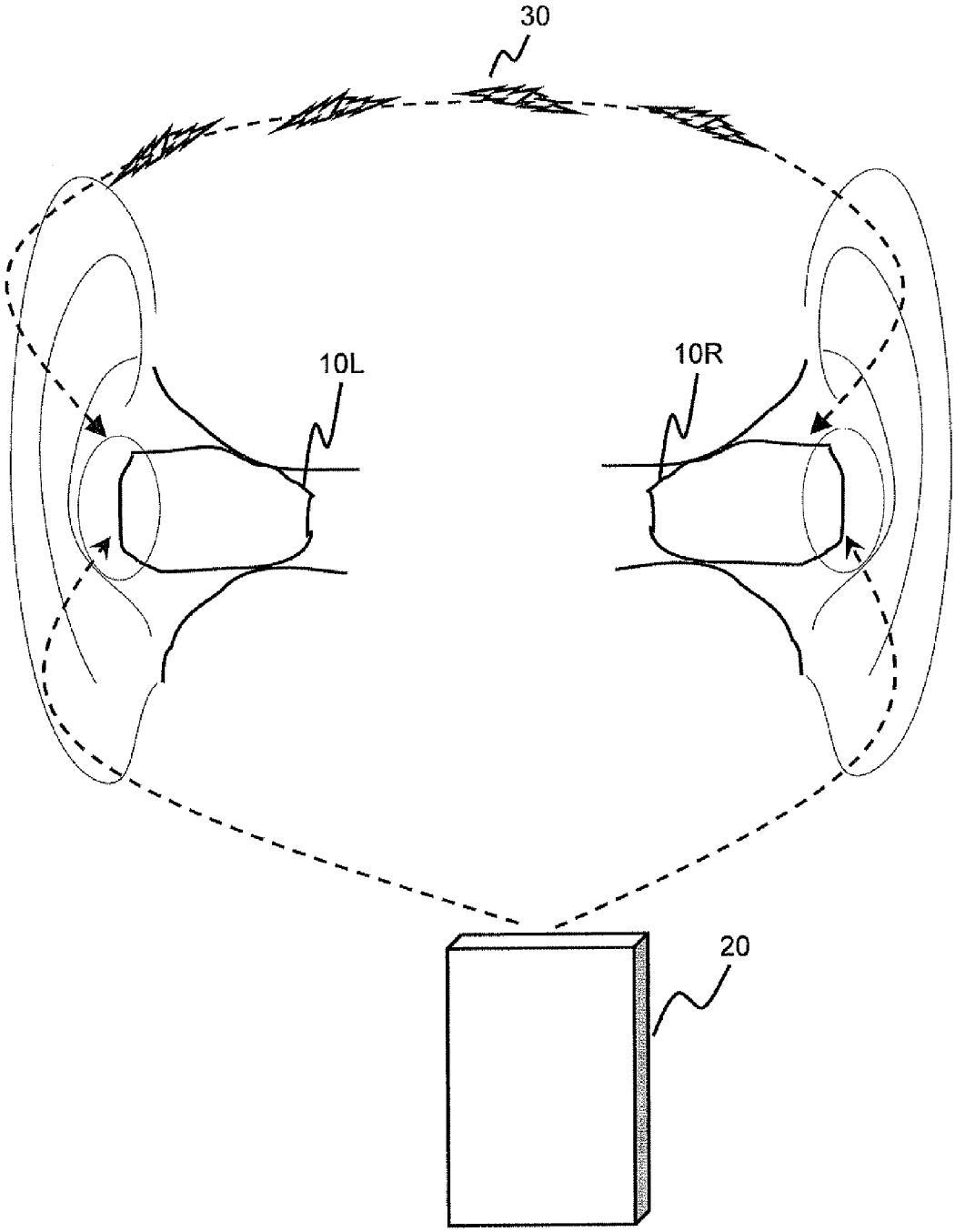
FIG. 1 is a concept diagram of the configuration of the hearing aid pertaining to an embodiment of the present invention.

FIG. 1 shows the configuration of the hearing aid in this embodiment, and is a concept diagram of a pair of left and right hearing aids is used for binaural application, and shows the state when a right-ear hearing aid 10R (a first hearing aid) and a left-ear hearing aid 10L (a second hearing aid) are each put on.

The hearing aids 10L and 10R are connected to each other via wireless communication 30, which allows the hearing aids 10L and 10R to exchange information about programs, volume changes, and so forth. A remote control 20 sends the two hearing aids information about programs, volume changes, and so forth.

Figure 2:
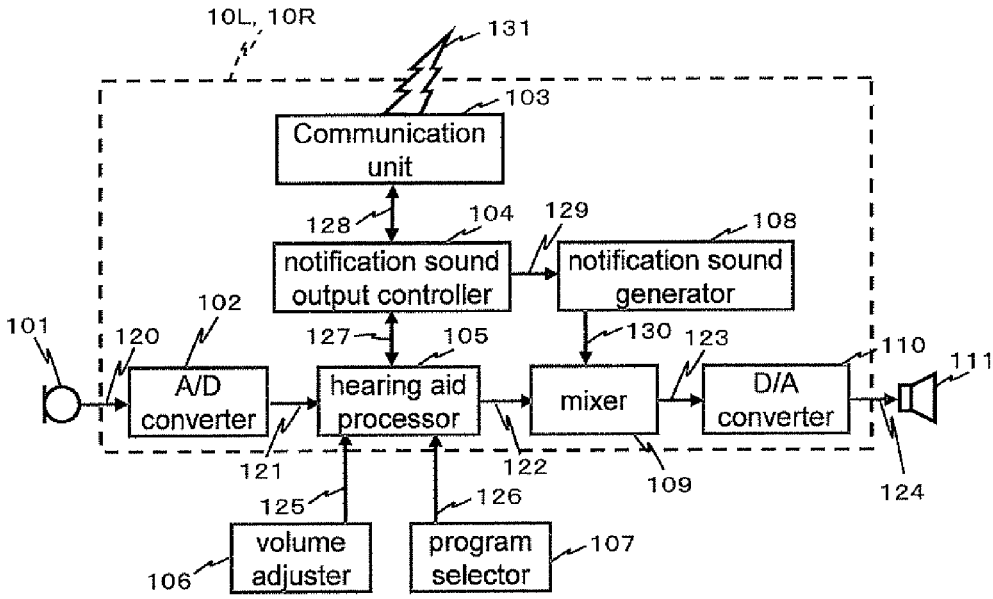
FIG. 2 is a block diagram of the configuration of the hearing aid in FIG. 1.
Figure 2:
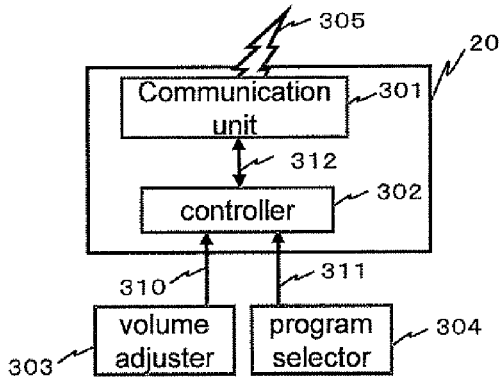

FIG. 2 is a block diagram that applies to both of the hearing aids 10L and 10R.

Ambient sound inputted from a microphone 101 is outputted as an analog speech signal 120. This signal is converted into a digital speech signal by an A/D converter 102, after which it is outputted as a digital speech signal 121. This signal is then subjected to various kinds of signal processing, including hearing aid processing, by a hearing aid processor 105, and then outputted as a speech signal 122 to a mixer 109.

A notification sound generator 108 generates a notification sound that notifies the wearer of battery failure, a program switch, etc., and outputs a notification sound signal 130 to the mixer 109.

The mixer 109 mixes the speech signal 122 that has undergone hearing aid processing and been outputted from the hearing aid processor 105, with the notification sound signal 130 outputted from the notification sound generator 108, and outputs the result as a digital speech signal 123 to a D/A converter 110.

The D/A converter 110 converts the digital speech signal 123 outputted from the mixer 109 into analog speech data, and outputs this as an analog speech signal 124.

A receiver 111 converts the analog speech signal 124 into air vibrations, which are outputted as sound information that can be heard by the wearer.

We will divide up the description here into a case in which the wearer manipulates either the hearing aid 10L or 10R to directly switch the operation of that hearing aid 10L or 10R, and a case in which the operation of one of the hearing aids 10L and 10R is switched according to a command received by the other hearing aid.

First, we will describe a case in which the wearer directly manipulates the hearing aid 10L or 10R for which the state is to be changed, and thereby switches the operation of that hearing aid.

The hearing aid processor 105 is connected to a volume adjuster 106 (operating unit) and a program selector 107 (operating unit) that are in the form of switches. Consequently, the wearer himself can adjust the volume with the volume adjuster 106, and can switch the program of the hearing aids 10L and 10R by manipulating the program selector 107.

A speech adjustment control signal 125 produced when the volume adjuster 106 is manipulated and a program change control signal 126 produced by the program selector 107 are inputted to the hearing aid processor 105. After the volume has been set or the program switched, that signal is outputted to a notification sound output controller 104.

The above-mentioned programs are speech processing programs for performing optimal hearing aid processing as dictated by the situation, such as whether the surroundings are noisy or quiet. In this embodiment, for example, the programs are divided into four types, from program A to program D, which are switched by user operating.

The volume adjuster 106 comprises up and down button. Pressing the up button increases the volume, and pressing the down button reduces the volume. More specifically, the volume is set from −32 dB to 0 dB, and each time the button is pressed it results in a change of 2 dB in the volume.

The notification sound output controller 104 determines whether or not a notification sound is necessary on the basis of data inputted as a control signal 127 or a control signal 128. If a notification sound is necessary, the notification sound output controller 104 outputs the type of notification sound as notification sound information 129 after a specific length of time has elapsed.

The notification sound output controller 104 also outputs the inputted control signal 127 directly to a communication unit 103 as the control signal 128. The communication unit 103 then sends the received control signal 128 as a wireless control signal 131 to the other of the hearing aids 10L and 10R, the one that was not directly manipulated by the wearer.

After receiving the notification sound information 129, the notification sound generator 108 outputs a notification sound corresponding to the type of notification sound.

As to whether or not a notification sound needs to be generated when a change in the state of the hearing aids 10L and 10R has been detected, this may be determined in accordance with the manufacturing and design intentions, such as when a notification sound is generated in the event of a program switch, for example, but there is no need to generate a notification sound in the event of a volume change.

Next, we will describe a case in which one hearing aid 10L receives the wireless control signal 131 from the other hearing aid 10R. Here, we will describe an example in which the hearing aid 10L receives the wireless control signal 131 from the hearing aid 10R, but the hearing aids 10L and 10R may be in the opposite relation.

The communication unit 103 outputs the wireless control signal 131 received from the hearing aid 10L to the notification sound output controller 104 as the control signal 128.

The notification sound output controller 104 determines whether or not a notification sound is necessary, and if it is necessary, the notification sound information 129 required to generate the notification sound is outputted to the notification sound generator 108. Upon receiving the notification sound information 129, the notification sound generator 108 outputs the notification sound signal 130 to the mixer 109.

Figure 3:
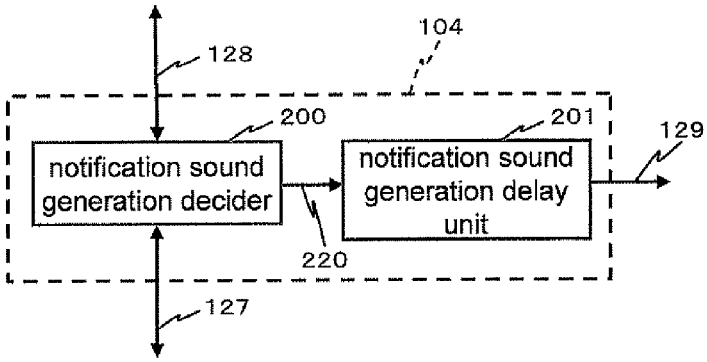
FIG. 3 is a block diagram of a notification sound output controller included in the hearing aid in FIG. 2.

Next, the notification sound output controller 104 will be described in detail through reference to FIG. 3.

The notification sound output controller 104 is constituted so as to include a notification sound generation decider 200 and a notification sound generation delay unit 201.

The notification sound generation decider 200 confirms the type of notification sound and the notification sound generation timing on the basis of the inputted control signal 128 or control signal 127.

The notification sound generation delay unit 201 delays the output of the notification sound information 129 until a specific amount of time has elapsed, on the basis of delay time information included in the control signal 128 or the control signal 127. In this embodiment, controlling this notification sound generation timing allows the output of the notification sounds produced by the left and right hearing aids 10L and 10R to be shifted (asynchronously) so that they are not outputted at the same time. This delayed output of the notification sound will be discussed in detail below.

Next, the timing of the notification sounds outputted from the left and right hearing aids 10L and 10R will be described.

Here, as an example of a notification sounds that are outputted, we will assume that the above-mentioned programs A to D are switched so that the outputted notification sound (beeping sound) is a "beep" (one time) in program A, a "beep, beep" (two times) in program B, a "beep, beep, beep" (three times) in program C, and a "beep, beep, beep, beep" (four times) in program D.

Figure 5:
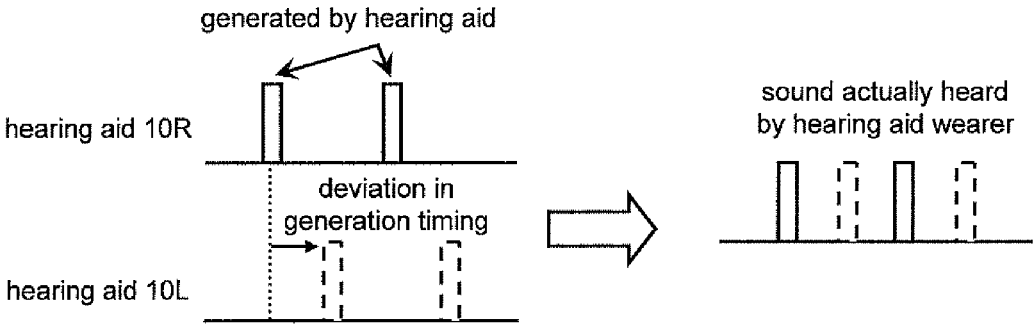
FIG. 5 is a diagram illustrating when a notification sound is incorrectly recognized.

For example, if the selected program is switched to program B so that a notification sound is generated two times by each of the left and right hearing aids 10L and 10R, as shown in FIG. 5, the timing at which the notification sounds are generated at the hearing aids 10L and 10R may end up deviating. If the notification sounds are outputted alternately at the left and right hearing aids 10L and 10R at this point, the wearer will hear a mixture of four notification sounds from the left and right ears, so there is the risk that the wearer will accidentally think the program has been switched to D, in which a notification sound is emitted four times.

One possible cause of such deviation in the timing at which the notification sounds are generated from the left and right hearing aids 10L and 10R is a case in which a command is sent from the remote control 20 to the hearing aids 10L and 10R, but because the left and right sides are linked, the transmitting hearing aid does not receive the command sent from the remote control. At this point, the hearing aid that has received the command resends the command to the other hearing aid, and timing deviation can occur in this process. Also, when just one hearing aid is manipulated, the command may not be received just as with remote control operation, or there may be timing deviation between the hearing aids 10L and 10R due to the transmission time required to send a command from one to the other, or timing deviation may occur when there is a different in the processing speed inherent to each hearing aid from the time a command is received until a notification sound is generated. Thus, it takes time to communicate a notification sound generation from one of the hearing aids 10L and 10R to the other, until the notification sound is generated on the side of the hearing aid that has received this communication, so there is a delay in the generation of the notification sounds between the left and right hearing aids 10L and 10R.

With the hearing aids 10L and 10R in this embodiment, this problem is solved by controlling the timing at which notification sounds are generated so that the notification sounds emitted from the hearing aids 10L and 10R are completely synchronized, as shown in FIGS. 6*a* to 6*e*, which is done to make it easier for the wearer of the hearing aids 10L and 10R worn on the left and right ears to hear the notification sounds. Consequently, the generation of notification sounds between the left and right hearing aids 10L and 10R can be completely synchronized, so the wearer can clearly identify the type of notification sound emitted.

The synchronization control of the notification sound generation timing will now be described in detail through reference to FIGS. 6*a* to 6*e*.

Figure 6:
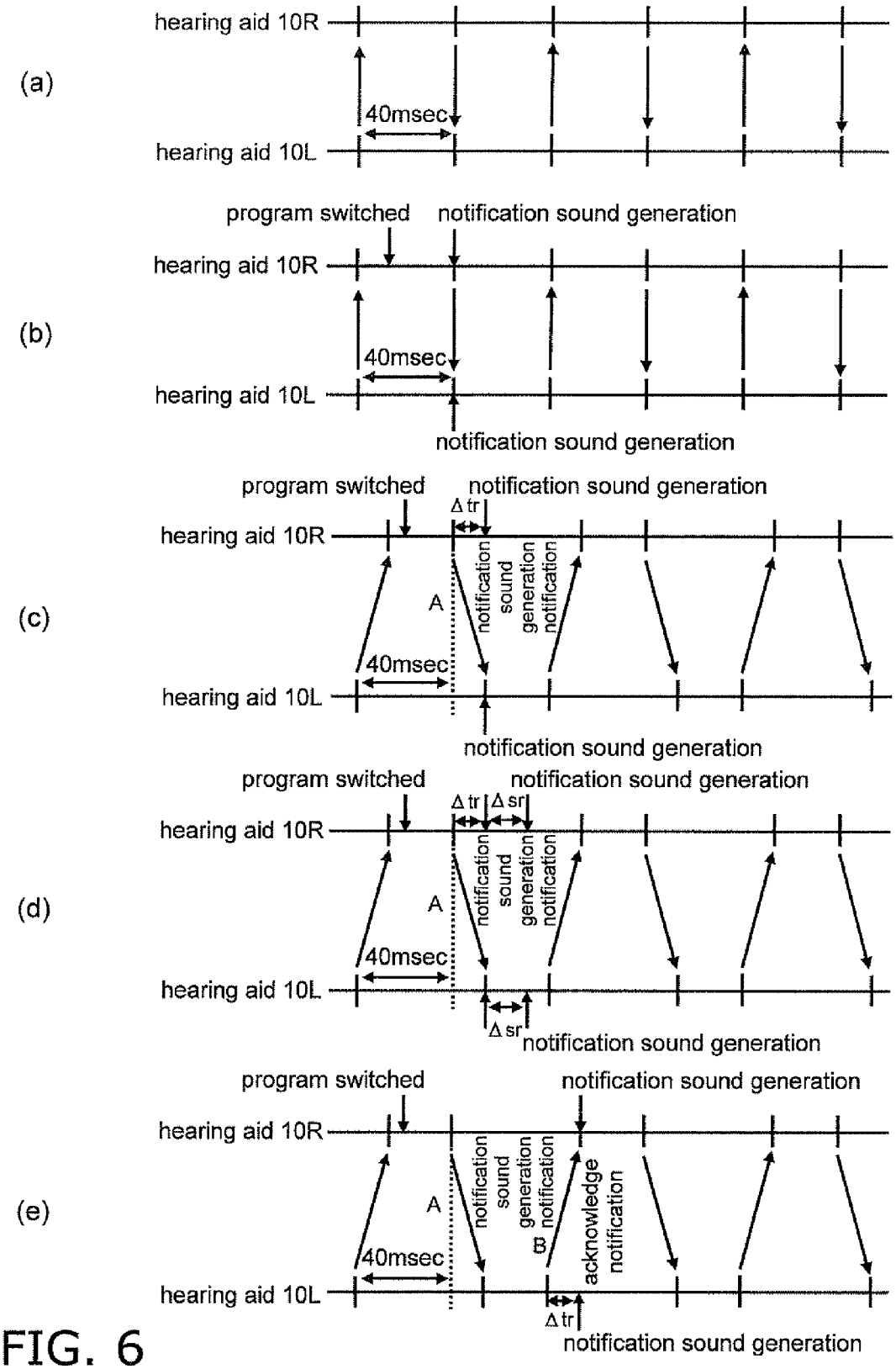
FIGS. 6*a* to 6*e* are diagrams illustrating details of how the notification sound generation timing is synchronized by the hearing aid in FIG. 1.

FIG. 6*a* illustrates the basic operation of the hearing aids 10L and 10R, which perform wireless communication.

The hearing aid 10R and the hearing aid 10L periodically communicate with each other at intervals of 40 ms. This periodic communication between the hearing aids 10L and 10R has two purposes: one is to confirm that the other hearing aid is within the range of communication, and the other is to send control signals, various parameters, and so forth to the other hearing aid.

FIGS. 6*b*, 6*c*, and 6*d* show an example of control for synchronizing the timing in the generation of notification sounds produced when a program is switched.

First, as shown in FIG. 6*b*, the hearing aid 10R, which has undergone a program switch via the program selector 107 by the wearer, is in a state in which a notification sound can be generated right away, but notification sound generation is not carried out immediately after this, and a notification sound is instead generated at the timing of the next periodic communication.

Here, periodic communication must be carried out at 40 ms intervals in order for the hearing aid 10R to tell the hearing aid 10L to make a notification sound. Therefore, if a notification sound is made at the same time that a program is switched on the hearing aid 10R side, the timing at which the notification sound is made will deviate by a maximum of 40 ms from that of the hearing aid 10L. Thus, in this embodiment, in order to prevent this deviation in the timing at which the notification sound is generated, control is performed so as to delay the generation of the notification sound on the hearing aid 10R side, where it is possible that a notification sound will be generated first.

More specifically, the notification sound generation delay unit 201 retards the generation of the notification sound by notifying the notification sound generator 108 later by the amount of time remaining from when the program is switched with the program selector 107 until the next transmission timing.

Consequently, the timing for generating the notification sound can be matched to the other hearing aid 10L.

With a hearing aid in which periodic communication is not performed between the hearing aids 10L and 10R, the time until the next transmission timing is not taken into account, and the other hearing aid 10L can be notified at the same time the program is switched, but as will be discussed below, the notification sound generation timing may be controlled by taking into account the processing time of the digital signal processor (DSP) and the time it takes for communication.

Next, we will describe an example in which the time communication actually takes, that is, the communication speed, is a factor that causes deviation in the notification sound generation timing between the hearing aids 10L and 10R.

As to communication speed, what speed of communication to employ, such as high-speed communication or low-speed communication, is a design matter, but low-speed communication is often used because of its lower cost and power consumption. When low-speed communication is used, there is the risk that the communication time may adversely affect the synchronization of notification sound generation. The term "communication speed" refers to how much data can be transferred in one second. The better is this ability, the higher is the communication speed, and the worse is this ability, the lower is the communication speed. Also, at a given communication speed, more communication data, that is, a larger packet size, is included in the idea of slower communication because it takes longer for the communication of one packet.

Here, if we let $\Delta tr$ be the time from the start of communication of the one hearing aid 10R until the completed receipt by the other hearing aid 10L, as shown in FIG. 6*c*, the hearing aid 10R generates a notification sound after the elapse of the time $\Delta tr$ after the hearing aid 10L has been notified of switched program information. Meanwhile, the hearing aid 10L generates a notification sound simultaneously with the hearing aid 10R at the point of receiving this notification.

That is, with the notification sound generation delay unit 201 on the hearing aid 10R side, the time obtained by adding $\Delta tr$ to the remaining time from when the program was switched via the program selector 107 until the timing of the next transmission is set as the delay time, and this is sent to the notification sound generator 108 so that the notification sound will be delayed more than usual. Consequently, the timing at which the notification sounds are generated by the hearing aids 10L and 10R can be synchronized.

Next, we will describe an example in which the operation speed of DSP computation processing or the like is a second factor that causes deviation in the notification sound generation timing between the hearing aids 10L and 10R.

Just as with the communication speed discussed above, when lower cost and power consumption are taken into account, a DSP with lower processing speed is usually used for the hearing aids 10L and 10R. Accordingly, the processing speed of this DSP must be taken into account in the synchronization of the notification sound generation timing.

As shown in FIG. 6*d*, if we let Δsr be the DSP processing speed (processing time), the notification sound output controller 104 of the hearing aid 10R on the transmission side generates a notification sound after the elapse of a time obtained by adding the sum of Δtr+Δsr to the remaining time from when the program was switched via the program selector 107 until the next transmission timing. After receiving a notification sound generation notification, the hearing aid 10L necessarily generates a notification sound after the elapse of the time Δsr. As a result, the timing at which the notification sounds are generated by the hearing aids 10L and 10R can be synchronized.

FIG. 6*e* is an example of when a notification sound is issued after checking that the hearing aid 10L has indeed received the information sent by the hearing aid 10R.

The hearing aid 10R sends the hearing aid 10L switched program information and delay time information (the time Δtr) as soon as a program is switched by the wearer via the program selector 107.

Upon receiving this notification, the hearing aid 10L generates a notification sound after the elapse of the time Δtr, simultaneously with the return of an acknowledge signal to the hearing aid 10R, at the next transmission timing. The hearing aid 10R generates a notification sound at the point when the acknowledge signal is received.

Although not shown in FIG. 6*e*, depending on the DSP processing capability of the hearing aids 10L and 10R, it may be preferable for the delay time to take Δsr into account as shown in FIG. 6*d*.

Consequently, it can be confirmed that the hearing aid 10L (on the receiving side) has definitely received the information sent from the hearing aid 10R, and notification sounds can be generated simultaneously from the hearing aids 10L and 10R.

The delay time Δsr is set at the design stage in the case of a model in which the hearing aids 10L and 10R mounted on both ears both have the same function, so this delay time can be stored in the main bodies of the hearing aids 10L and 10R ahead of time. On the other hand, when using a model in which the functions are different for the left and right ears, such as when a hearing aid for a patient with severe hearing impairment is used on one ear and a hearing aid for a patient with mild hearing impairment is used on the other ear, a different DSP may be installed in each of the hearing aids, or there may be a difference in the delay time Δsr between the hearing aids 10L and 10R. In such a case, delay time information may be shared between the left and right hearing aids by conveying information related to the delay time Δsr via the communication unit 103 and through a communication packet.

The communication packed sent and received by the hearing aids 10L and 10R in this embodiment will now be described through reference to FIG. 4.

A packet is mainly divided into a command region that identifies the type of command, a parameter region containing parameters, and a delay time region that specifies the notification sound generation timing.

Program changes, changes to the volume of the output sound, remaining battery charge warnings, and other such types of commands are stored as numerical values in the command region. Also, parameters for those commands, such as one of programs A to D in the case of a program change, are stored in the command region, and in the case of a volume change, a numerical value from −32 dB to 0 dB is stored. The delay time information discussed above is stored in the delay time region.

If no periodic communication is performed between the left and right hearing aids 10L and 10R, the time until the above-mentioned next transmission timing is not taken into account, and a notification may be sent to the hearing aid on the other side simultaneously with a program switch.

Consequently, the one hearing aid 10R can ascertain the processing capability of the other hearing aid 10L, so the proper delay time can be set to allow notification sounds to be generated at the same time.

Next, we will describe a case in which the hearing aids 10L and 10R are operated remotely with the remote control 20 (see FIG. 2).

Usually, the operation of both the hearing aids 10L and 10R is switched by operation of the remote control 20, but in rare situations a wireless control signal 305 may reach only one of the hearing aids due to the reception state of the hearing aids 10L and 10R. In a case such as this, a problem is that the operation is switched at only one of the hearing aids.

In this embodiment, to solve this problem, the hearing aids 10L and 10R notify each other of notification sound generation as shown in FIG. 6*e* when the wireless control signal 305 is received from the remote control 20, and control is performed so that notification sounds are generated after the hearing aids 10L and 10R have exchanged information (acknowledge signals) to the effect that the wireless control signal 305 has been received.

As discussed above, with the hearing aids 10L and 10R of this embodiment, even when they are worn on both ears, the timing at which notification sounds are generated at the hearing aids 10L and 10R is controlled so that the notification sounds can be generated at the same time from the hearing aids 10L and 10R. As a result, the wearer can clearly distinguish between types of notification sounds, and an accurately hear them without any recognition error.

Embodiment 2

The hearing aid pertaining to another embodiment of the present invention will now be described through reference to FIGS. 7 to 9*c*.

With this embodiment, the control differs from that in Embodiment 1 above in that asynchronous control is performed in which the separate notification sounds emitted from the hearing aids 10L and 10R are completely offset so that they can be distinguished apart, and this is done as control for making it easier for the wearer of the hearing aids 10L and 10R mounted on the left and right ears to hear the notification sounds.

In this embodiment, those units that have the same function as in Embodiment 1 above will be numbered the same, and will not be described again.

Figure 7:
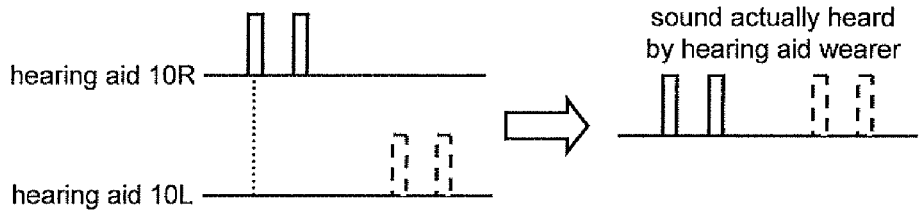
FIG. 7 is a diagram illustrating the notification sound generation timing with a hearing aid pertaining to another embodiment of the present invention.
Figure 8:
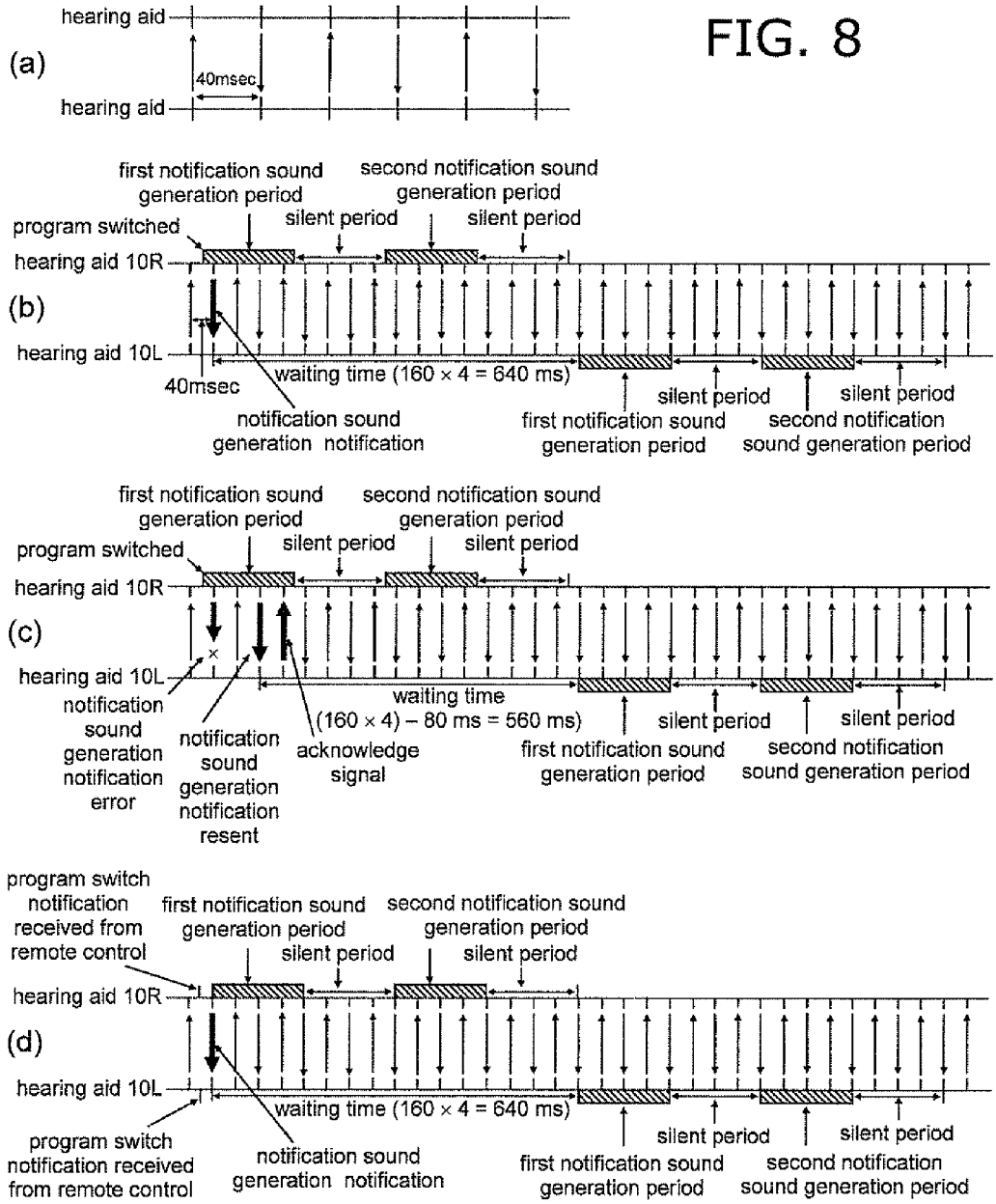
FIGS. 8*a* to 8*d* are diagrams illustrating details of how notification sounds are generated asynchronously with another embodiment of the present invention.
Figure 9:
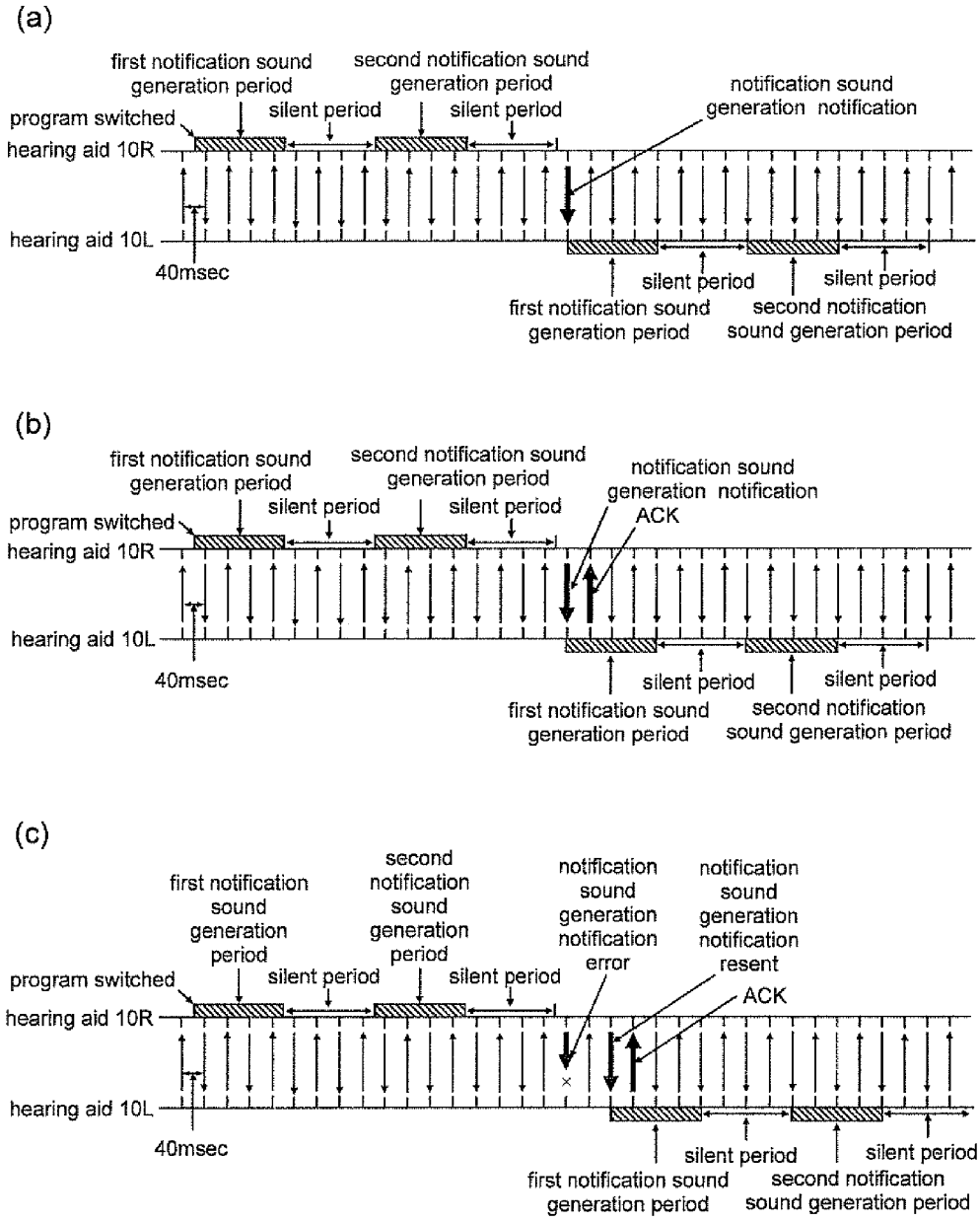
FIGS. 9*a* to 9*c* are diagrams illustrating the state when the program is switched with a hearing aid in another embodiment of the present invention.

With the hearing aids 10L and 10R in this embodiment, to solve this problem, as shown in FIG. 7, the notification sound generation timing is controlled so that upon completion of the generation of the notification sound outputted first from among the hearing aids 10L and 10R, the notification sound on the side generated later is generated after the elapse of a specific length of time. Consequently, the generation of notification sounds can be completed separated temporally between the left and right hearing aids 10L and 10R, so the wearer can clearly recognize the type of notification sound.

Next, the asynchronous method for notification sound generation timing will be described through reference to FIGS. 8*a* to 8*d*.

First, the basic operation in a case in which wireless communication is performed between the left and right hearing aids 10L and 10R will be described through reference to FIG. 8*a*.

In this embodiment, the hearing aid 10R and the hearing aid 10L periodically sent information to each other at intervals of 40 ms. The periodic communication between the hearing aids 10L and 10R serves two purposes: confirming whether or not the other hearing aid is within communication range, and sending various parameters, control signals, and so forth to the other hearing aid.

FIGS. 8*b* and 8*c* show an example of control for generating notification sounds that are asynchronously offset from one another when the program has been switched.

First, as shown in FIG. 8*b*, the hearing aid 10R, for which the program has been switched by the wearer, generates a notification sound immediately after this switch. The hearing aid 10R sends the hearing aid 10L delay time information and switched program information as a notification sound generation notification. We will assume that this notification sound generation notification includes program information for a setting change performed by the hearing aid 10L, and delay time information specifying the notification sound generation timing, within a communication packet (discussed below).

Figure 4:
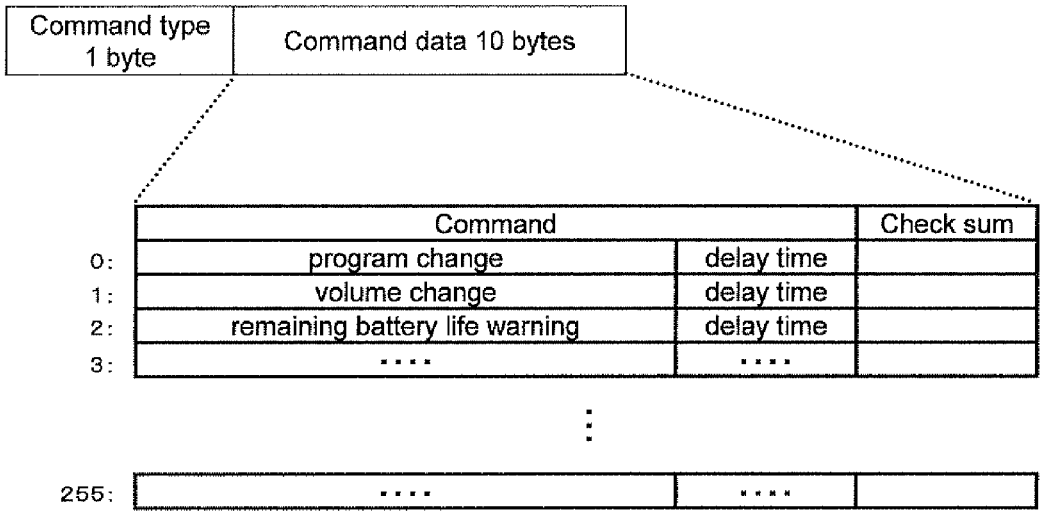
FIG. 4 is a diagram of the configuration of a packet sent to and from the hearing aid in FIG. 1.

Again in this embodiment, just as in Embodiment 1 above, the communication packet shown in FIG. 4 is used as the communication packet sent to and received by the hearing aids 10L and 10R.

The delay time stored in this communication packet is the timing for generating a notification sound at the hearing aid 10L, and is the length of time until the end of notification sound generation at the hearing aid 10R. As to the notification sound generation duration, a single notification sound generation time is 160 ms, followed by a non-generation time of 160 ms to make up a set, and this set of 320 ms is termed the notification sound generation duration. For example, with a notification sound indicating a switch to program B, since a two-time notification sound is generated with program B, a time of 640 ms (two sets) is necessary. This delay time is conveyed to the hearing aid 10L, whereupon notification sound generation at the hearing aid 10L is started after the end of notification sound generation at the hearing aid 10R. As a result, notification sounds can be generated from the left and right hearing aids 10L and 10R in a state of complete separation, without any overlap between the two.

FIG. 8*c* is an example of processing for confirming that the notification sound generation notification sent by the hearing aid 10R has indeed been received by the hearing aid 10L. It is conceivable that the notification sound generation notification will not arrive, and this is a contingency for such a case, in which the notification sound generation notification is retried a number of times.

When the wearer has switched the program for the hearing aid 10R, that hearing aid notifies the hearing aid 10L of switched program information and delay time information. The hearing aid 10L returns an acknowledge signal at the next transmission timing, and generates a notification sound after the elapse of a delay time based on the received delay time information.

If the communication state between the left and right hearing aids 10L and 10R is so poor that the hearing aid 10L does not receive the notification sound generation notification, the hearing aid 10L cannot return an acknowledge signal. If no acknowledge signal comes back, a notification sound generation notification is sent again to the hearing aid 10L.

At this point, the delay time set by the hearing aid 10R must be adjusted for the delay in notification since the notification sound generation notification was resent. In this case, communication fails with the first notification sound generation notification, but succeeds with the second notification sound generation notification, so the delay is only 80 ms from the first notification until the second notification. Thus, the delay time conveyed to the hearing aid 10L is reset to 560 ms, which is obtained by subtracting this time of 80 ms.

Consequently, after confirming that the other hearing aid 10L has indeed received the notification, the timing at which the notification sounds are outputted from the hearing aids 10L and 10R can be clearly offset so that there is no overlap.

In this embodiment, the hearing aid 10R generates a notification sound as soon as the program is switched by the wearer, but the control may be such that a notification sound is generated at the point when an acknowledge signal is received from the hearing aid 10L.

Next, a case in which the hearing aids 10L and 10R are remotely operated with the remote control 20 will be described.

As shown in FIG. 2, the remote control 20 comprises a communication unit 301 that communicates with the hearing aids 10L and 10R, a controller 302 that controls the function of the remote control 20, a volume adjuster 303 that adjusts the volume of the hearing aids 10L and 10R, and a program selector 304 for switching the program. The volume adjuster 303 and the program selector 304 are provided to the remote control 20 as switch-like constituent members.

For example, when the remote control 20 is used to change the volume of the hearing aids 10L and 10R, the volume adjuster 303 is operated so that a volume adjustment control signal 310 is sent as a wireless control signal 305 through the controller 302 and the communication unit 301 to the hearing aids 10L and 10R. Just as when the program is switched, a program change control signal 311 is sent as a wireless control signal 305 from the program selector 304, through the controller 302 and the communication unit 301, to the hearing aids 10L and 10R.

Usually, the operation of both of the hearing aids 10L and 10R is switched by operation of the remote control 20, but when the hearing aids 10L and 10R generate notification sounds at the same time, as discussed above, there is the risk that the notification sound generation from the left and right hearing aids 10L and 10R will be offset due to factors such as communication errors and processing speed.

In this embodiment, this problem is solved by having the hearing aids 10L and 10R alternately communicate with each other periodically (every 40 ms). This alternate communication refers to alternately switching the communication direction from the hearing aid 10R to the hearing aid 10L, and then from the hearing aid 10L to the hearing aid 10R, as discussed above.

As shown in FIG. 8*d*, when the hearing aids 10L and 10R both receive notification sound generation notifications from the remote control 20, the side capable of transmission performs notification sound generation notification to the other side.

In FIG. 8*d*, after a notification sound generation notification from the remote control 20 is received, communication from the hearing aid 10R to the hearing aid 10L is first. Therefore, the hearing aid 10R starts generating a notification sound at this point, and sends a notification sound generation notification to the hearing aid 10L. Having received the notification sound generation notification, the hearing aid 10L generates a notification sound after the designated delay time. Consequently, the timing at which the notification sounds are generated can be clearly shifted between the hearing aids 10L and 10R.

FIG. 9*a* shows the state when the hearing aid 10R has been switched to program B.

Having had its program switched by the wearer, the hearing aid 10R generates a notification sound, after which it sends a notification sound generation notification to the hearing aid 10L at the point of completion of notification sound generation 640 ms later. The hearing aid 10L generates a notification sound after receiving the notification sound generation notification.

With this method, the completion of notification sound generation by the hearing aid 10R acts as a trigger for performing switch notification to the hearing aid 10L. Accordingly, there is no need to notify the hearing aid 10L on the other side of the delay time, and this control can be accomplished more easily.

FIGS. 9*b* and 9*c* show the flow in returning an acknowledge signal after receipt of a notification sound generation notification.

As shown in FIG. 9*b*, having received the notification sound generation notification, the hearing aid 10L returns an acknowledge signal at the next communication timing, and notifies the hearing aid 10R of its safe receipt of the signal. Consequently, the hearing aid 10R confirms that the notification sound generation notification has been properly transmitted, after which the operation is ended.

FIG. 9*c* shows the processing when a notification sound generation notification sent by the hearing aid 10R did not reach the hearing aid 10L for one reason or another.

In this case, the hearing aid 10L cannot return an acknowledge signal because no notification sound generation notification was received. In view of this, notification sound generation notification is performed again by the hearing aid 10R to which no acknowledge signal was returned. This allows a notification sound generation notification to be sent more reliably to the hearing aid 10L on the other side.

As discussed above, with the hearing aids 10L and 10R in this embodiment, even when hearing aids are worn on both the left and right ears, the notification sounds can be clearly heard by the wearer because the timing at which the notification sounds are generated from the hearing aids 10L and 10R is controlled, and the timing at which the notification sounds are outputted from the hearing aids 10L and 10R is clearly shifted.

Other Embodiments (A)

In Embodiments 1 and 2 above, an example was described in which a beeping sound (electronic sound), such as "beep" or "beep, beep," was made as the notification sound according to the selected program, but the present invention is not limited to this. For instance, a melody, human speech, and so forth may be used as the notification sound instead of what was discussed above.

(B)

In the above embodiments, an example was described in which the state change of the hearing aids 10L and 10R was a switch of programs or volume via the hearing aids themselves or the remote control 20, but the present invention is not limited to this. For instance, a switch may be performed automatically according to the surrounding environment, or another state change related to the hearing aids may be detected and the above-mentioned control carried out.

Industrial Applicability

The hearing aid pertaining to the present invention controls the timing at which notification sounds from two hearing aids are generated, making it easier for the wearer to hear the notification sounds, and therefore is expected to find wide application as a binaural hearing aid.

REFERENCE SIGNS LIST

10L hearing aid (second hearing aid)
10R hearing aid (first hearing aid)
20 remote control
30 wireless communication
101 microphone
102 A/D converter
103 communication unit
104 notification sound output controller
105 hearing aid processor
106 volume adjuster (operating unit)
107 program selector (operating unit)
108 notification sound generator
109 mixer
110 D/A converter
111 receiver
120, 124 analog speech signal
121, 122, 123 digital speech signal
125 speech adjustment control signal
126 program change control signal
127, 128 control signal
129 notification sound information
130 notification sound signal
131 wireless control signal
200 notification sound generation decider
201 notification sound generation delay unit
301 communication unit
302 controller
303 volume adjuster (operating unit)
304 program selector (operating unit)
305 wireless control signal
310 volume adjustment control signal
311 program change control signal

The invention claimed is:

1. A hearing aid that is mounted on the left and right ears, respectively, and generates a notification sound that notifies the user of a state change, comprising:

a first hearing aid and a second hearing aid mounted on the left and right ears, respectively, wherein the first and second hearing aids each have:

a communication unit configured to communicate between the first and second hearing aids;

an operating unit configured to change the operating state of the first and second hearing aids;

a notification sound generator configured to generate the notification sound when the operating state of the first and second hearing aids is changed due to operating of the operating unit; and a notification sound generation delay unit configured to control the notification sound generator of the second hearing aid or the first hearing aid so as to delay by a specific amount the timing at which a notification sound is generated by the notification sound generator in the first hearing aid or the second hearing aid, on the basis of delay time information received through the communication unit.

2. The hearing aid according to claim 1, wherein the notification sound generation delay unit controls so that the generation of a notification sound by whichever of the first and second hearing aids that is able to generate a notification sound first is made to wait until a specific delay time has elapsed, and is synchronized with the generation timing of a notification sound by the other notification sound generator.

3. The hearing aid according to claim 1, wherein the notification sound generation delay unit controls the other notification sound generator so that generation of a notification sound is delayed until a specific delay time has elapsed after the end of the generation of a notification sound by whichever of the first and second hearing aids that generated a notification sound first.

4. The hearing aid according to claim 1, wherein the communication unit performs communication periodically at a specific interval.

5. The hearing aid according to claim 1, wherein the first hearing aid or the second hearing aid receives a notification sound generation notification signal from the second hearing aid or the first hearing aid via the communication unit, and then returns an acknowledge signal at the next communication timing and generates a notification sound after the elapse of a specific delay time, and the second hearing aid or the first hearing aid receives the acknowledge signal and then generates a notification sound after the elapse of a specific delay time.

6. The hearing aid according to claim 1, wherein the operating unit is a switch provided to the first and second hearing aids.

7. The hearing aid according to claim 1, wherein the operating unit is a switch that is connected by wire or wirelessly to the first and second hearing aids, and performs remote control.

8. The hearing aid according to claim 1, wherein the delay time information is set on the basis of how long it takes from the changing of the operating state with the operating unit of the first hearing aid or the second hearing aid until the next transmission by the communication unit of the first hearing aid or the second hearing aid.

9. The hearing aid according to claim 1, wherein the delay time information is set on the basis of a delay time generated by communication at the communication unit.

10. The hearing aid according to claim 1, wherein the delay time information is set on the basis of how long it takes for digital signal processing in the first and second hearing aids.

11. The hearing aid according to claim 1, wherein the delay time information is set on the basis of a length of time obtained by adding the time it takes for communication at the communication unit to the time it takes for the digital signal processing.

12. The hearing aid according to claim 1, wherein the first and second hearing aids further comprise a memory unit configured to store the specific delay time.

13. The hearing aid according to claim 1, wherein the first and second hearing aids transmit the delay time information to the corresponding second and first hearing aids via the communication unit.

* * * * *